US010088288B1

(12) United States Patent
Caska et al.

(10) Patent No.: US 10,088,288 B1
(45) Date of Patent: Oct. 2, 2018

(54) MUNITION FUZE WITH BLAST INITIATED INDUCTANCE GENERATOR FOR POWER SUPPLY AND LASER IGNITOR

(71) Applicant: The United States of America as Represented by the Secretary of the Army, Washington, DC (US)

(72) Inventors: Kevin Caska, Vernon, NJ (US); Andrew Zimmer, Wharton, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/726,626

(22) Filed: Oct. 6, 2017

Related U.S. Application Data

(60) Provisional application No. 62/404,893, filed on Oct. 6, 2016.

(51) Int. Cl.
*F42C 11/04* (2006.01)
*F42C 11/06* (2006.01)

(52) U.S. Cl.
CPC ..... *F42C 11/04* (2013.01); *F42C 11/06* (2013.01)

(58) Field of Classification Search
CPC ..... F42C 11/04; F42C 11/06; F42C 11/065; F42C 11/003; F42C 11/008; F42C 15/34; F42C 15/36
USPC ..... 102/207, 209
See application file for complete search history.

(56) References Cited

U.S. PATENT DOCUMENTS

| | | | | |
|---|---|---|---|---|
| 3,636,390 | A | 1/1972 | Stauder | |
| 4,637,311 | A | 1/1987 | Rehmann | |
| 5,229,542 | A | 7/1993 | Bryan | |
| 6,082,267 | A | 7/2000 | Cooper | |
| 6,460,460 | B1 | 10/2002 | Jasper, Jr. | |
| 6,647,889 | B1 * | 11/2003 | Biserød | F15B 15/19 102/489 |
| 7,013,809 | B1 | 3/2006 | Munoz Bueno | |
| 7,051,655 | B1 | 5/2006 | Moulard | |
| 7,197,983 | B2 | 4/2007 | Barth | |
| 7,810,430 | B2 | 10/2010 | Chan | |
| 8,408,134 | B2 | 4/2013 | Sibum | |
| 8,651,979 | B2 | 3/2014 | Veksler | |
| 8,887,640 | B1 | 11/2014 | Knight | |
| 9,279,645 | B2 | 3/2016 | Schlenter | |
| 2013/0284042 | A1 * | 10/2013 | Silverman | F42C 11/008 102/202.7 |

FOREIGN PATENT DOCUMENTS

CH 420917 * 9/1966

* cited by examiner

*Primary Examiner* — Stephen Johnson
(74) *Attorney, Agent, or Firm* — John P. DiScala

(57) ABSTRACT

The munition employs an energetically initiated electromagnetic pulse through a coil which induces a voltage intended to be used for the operation of an electronic time delay circuit and subsequent ignition of a detonation device. Explosive energy from a primer is employed to move a generator core through a generator coil to induce the voltage. The voltage is supplied to a delay circuit. After a set time, the delay circuit supplies power to a laser igniter which detonates the munition. A striker assembly, in addition to initiating the primer, functions as an out of line safety as well as an electric safety.

13 Claims, 9 Drawing Sheets

MUNITION FUZE WITH BLAST INITIATED INDUCTANCE GENERATOR FOR POWER SUPPLY AND LASER IGNITOR

CROSS-REFERENCE TO RELATED APPLICATIONS

This application claims the benefit under 35 USC § 119(e) of U.S. provisional patent application 62/404,893 filed on Oct. 6, 2016.

STATEMENT OF GOVERNMENT INTEREST

The inventions described herein may be manufactured, used and licensed by or for the United States Government.

BACKGROUND OF THE INVENTION

The invention relates in general to fuzes and in particular to fuzes for munitions, such as hand grenades.

Conventional hand grenades typically include pyrotechnic based fuzes. In such a fuze, a firing pin strikes a primer to initiate the energetic chain. The primer ignites a delay mixture which after a set period of time ignites one or more successive energetic compounds to produce the explosive effect of the grenade.

However, these successive energetic compounds often include hazardous chemical compounds such as perchlorates and heavy metals. The presence of such compounds can have adverse effects on the environment and potentially impact compliance with environmental standards. Additionally, traditional pyrotechnic fuzes have systemic issues in the field related to insensitive munition compliance requirements. These fuzes contain energetic trains that are sensitive to impact stimuli such as bullet, fragmentation and shape charge effects. Primer cook off is an additional concern. These issues create potential hazards for users in both logistical and tactical configurations.

It has been a long desire to initiate grenades with an electronically operated fuze delay. This approach would provide several benefits over the traditional pyrotechnic based fuzes. Advantages of the electronic fuze could include greater reliability, reduced functional variability, specific and extremely consistent programmable delay times, less susceptibility to operational environment, reduced production quality issues, more environmentally friendly characteristics, increased compliance with insensitive munition requirements and increased user safety.

Past efforts to integrate electronic fuzes in grenades have been hampered by inadequate power supplies. To be suitable for use in a munition, the fuze must have a power supply which has shelf life longevity, functionality in extreme operational conditions, reliability, rapid rise time, insensitivity to electrostatic radiation and radio frequency; all while still being cost effective.

A need exists for a munition with an electronic fuze with a reliable and resilient power source which meets required operational needs.

SUMMARY OF INVENTION

One aspect of the invention is a fuze for a munition comprising a laser igniter for detonating a main energetic charge, an inductance generator assembly and a striker assembly. The inductance generator assembly further comprises a generator core, a generator coil and a primer charge and generates electric power from a detonation of the primer charge and provides the electric power to the laser igniter. The striker assembly detonates the primer charge of the inductance generator assembly.

A second aspect of the invention is a fuze for a hand grenade. The fuze includes an inductance generator assembly, a laser igniter assembly, a delay circuit and a striker assembly. The inductance generator assembly further includes a primer charge disposed in a blast chamber, a piston actuator having an input end exposed to the interior of the blast chamber, a generator core aligned with the output end of the piston actuator, a bore defined by the inductance generator assembly and extending orthogonally from the generator core, a generator coil concentric with a portion of the bore. The piston actuator transfers energy from a detonation of primer charge to propel the generator core through the generator coil to produce electric energy. The laser igniter assembly receives electric energy to ignite an energetic charge. The delay circuit is in electric communication with the inductor generator assembly and the laser igniter assembly and receives the generated electric energy from the inductance generator assembly and after a predetermined time supplies the electric energy to the laser igniter assembly. The striker assembly detonates the primer charge of the inductance generator assembly. The striker assembly further comprises a lever arm wherein when in an engaged position, the lever arm restrains a pin which holds the generator core out of line and opens a circuit between the inductance generator assembly and the laser igniter assembly. When in a disengaged state, the striker assembly rotates around a hinge to strike the primer charge while allowing the generator core to move in line and allows the circuit between the blast initiated inductance generator assembly and the laser igniter to be completed.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
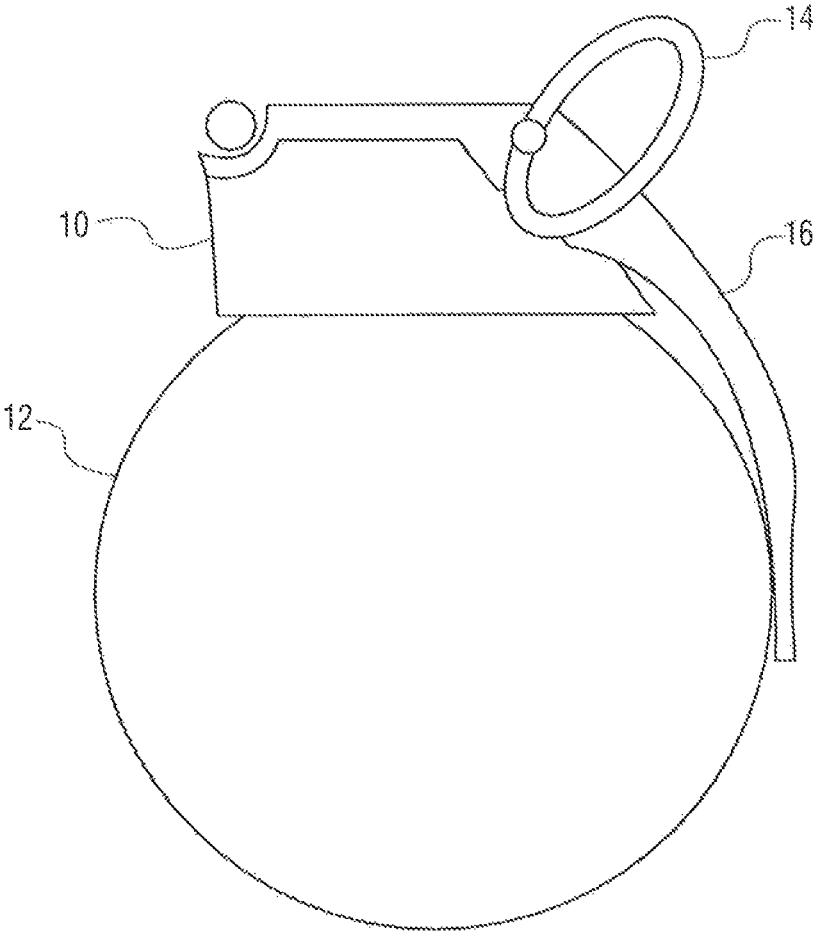
FIG. 1 is a side view of a grenade with a fuze having a blast initiated inductance generator, in accordance with one illustrative embodiment.

The munition employs an energetically initiated electromagnetic pulse through a coil which induces a voltage intended to be used for the operation of an electronic time delay circuit and subsequent ignition of a detonation device. Explosive energy from a primer is employed to activate a piston actuator and move a generator core through a generator coil to induce the voltage. The voltage is supplied to an electronic time delay circuit. After a set time, the delay circuit supplies power to a light emitting diode (LED) laser igniter which detonates the munition. A striker assembly, in addition to initiating the primer, functions as an electric safety. Furthermore, the striker assembly constrains a physical out of line safety feature until the munition is intentionally activated.

Advantageously, the blast initiated inductance generator allows for the elimination of significant amounts of hazardous pyrotechnic materials including perchlorates and heavy metals thereby greatly facilitating "green ammo" compliance. The munition includes a significantly reduced target area for "impact stimuli" (such as bullet fragments) thereby greatly improving safety and facilitating insensitive munition compliance. An additional advantage which facilitates insensitive munition compliance is the significant resistance of the fuze to electrostatic radiation. Safety and insensitive munition compliance are further improved by the incorporation of an "out of line" design characteristic.

Incorporation of an electronic time delay circuit provides programmable and consistent delay times coupled with near instantaneous rise time of the power source. This greatly improves reliability over the traditional pyrotechnic delay components and reduces the cost of quality during production by eliminating these delay components.

The power supply provides shelf life longevity and functionality in extreme operational conditions (hot and cold conditions). The fuze is a one shot device with rapid rise time to reduce variability and increase reliability. Additionally, the fuze is cost effective as the cost is significantly less than most solid state and reserve battery options.

Finally, the electronic fuze may be employed across multiple commodities with only minor variations required in the delay circuit and the detonation devices to achieve the necessary variable results. Contemporary hand grenade fuzes currently demand a wide variety of designs and pyrotechnic formulations across commodities to achieve desired delay times and output effects.

Throughout this specification, the munition will be described in the context of a hand grenade. While the fuze may be employed in lethal hand grenades, non-lethal hand grenades, smoke grenades, stun grenades, pyrotechnic grenades and obstruction grenades, the fuze is not limited to use in a hand grenade. The fuze may be employed in other military munitions and products that have similar design requirements and operational considerations. For example, the fuze may be employed in artillery or mortar projectiles as well as rifle or grenade launcher projectiles. Further, the fuze may be employed in related applications in other industries, such as in mining detonators, detonators for fireworks and other non-military explosives and in vehicle safety detonators such as those used in air bags.

FIG. 1 is a side view of a grenade with a fuze having blast initiated inductance generator, in accordance with one illustrative embodiment. The fuze 10 detonates the hand grenade upon activation by a user. The grenade comprises a fuze 10, a grenade body 12, a safety pull pin 14 and a grenade lever 16. The grenade body houses the main energetic fill of the grenade.

Advantageously, the hand grenade shown in FIG. 1 is both similar in size and operation to current hand grenades thereby requiring little modification, if any, to current equipment or training. The fuze 10 comprises external dimensions similar to a conventional pyrotechnic fuze for a hand grenade. From the perspective of a user, the hand grenade functions in a similar manner to a hand grenade having a pyrotechnic fuze. Namely, in the embodiment shown, the hand grenade is activated by a user by the removal of the safety pin which allows the release of the lever thereby allowing a striker assembly to detonate a primer charge.

The fuze 10 is inserted into the grenade body such that a lower portion of the fuze housing enclosing an LED laser igniter assembly is disposed within the grenade body thereby allowing the LED laser igniter to be in communication with the main energetic charge of the grenade, either directly or via an energetic chain. Portions of the fuze 10 are external to the grenade body thereby allowing initiation by the striker assembly.

Figure 2:
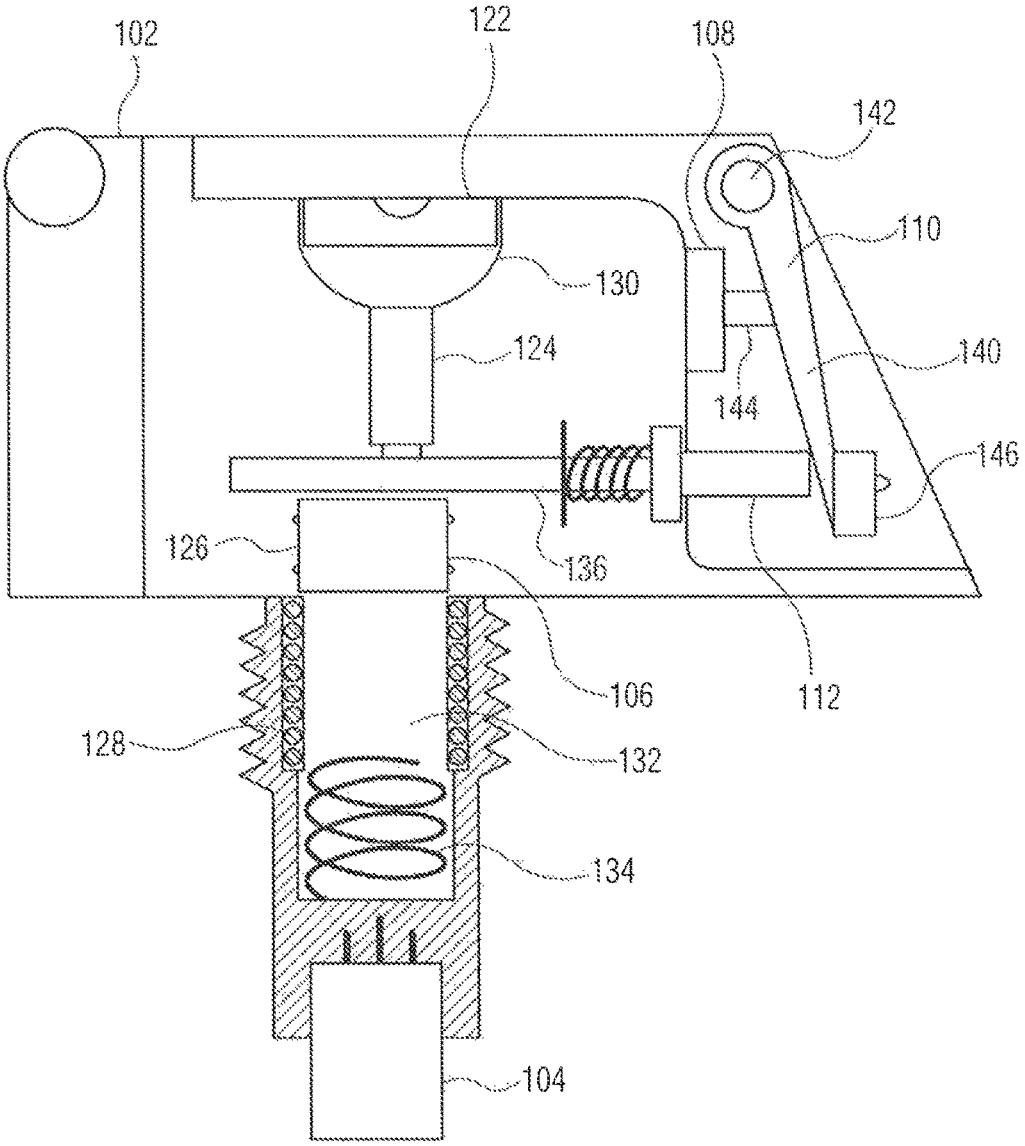
FIG. 2 is a cross-sectional view of the fuze having a blast initiated inductance generator, in accordance with one illustrative embodiment.

FIG. 2 is a cross sectional view of a fuze having a blast initiated inductance generator, in accordance with one illustrative embodiment. The fuze 10 comprises a housing 102, an LED laser igniter assembly 104 for detonating the main energetic charge of the grenade, a blast initiated inductance generator assembly 106 for generating power for the LED laser igniter assembly 104, an electronic time delay circuit 108 electrically positioned between the LED laser igniter assembly 104 and blast initiated inductance generator assembly 106 for providing a delay time before the grenade is armed, a striker assembly 110 for initiating the blast initiated inductance generator assembly 106 in response to user activation of the hand grenade and an out-of-line safety mechanism 112.

The blast initiated inductance generator assembly 106 further comprises a primer charge 122, an energetically operated mechanism 124, a generator core 126 and a generator coil 128. The primer charge 122 is affixed to the top surface of the inductance generator assembly 106 thereby allowing for the striker assembly 110 to contact and detonate the primer charge 122. A blast chamber 130 is positioned adjacent the primer charge 122 for containing the explosive energy of the primer charge 122 detonation. An energetically operated mechanism, such as a piston actuator 124, is positioned between the primer charge 122 and the generator core 126 with an input end of the piston actuator 124 exposed to the blast chamber 130. While throughout the specification the energetically operated mechanism 124 is described as a piston actuator 124, the energetically operated mechanism 124 is not limited to a piston actuator 124. The energetically operated mechanism 124 may be any mechanism which receives explosive energy and converts the explosive energy to kinetic energy.

The generator core 126 is positioned such that an upper surface is contiguous with an output end of the piston actuator 124. As will be described in further detail below, in embodiments, an out-of-line safety mechanism 112 comprising a selectively removable rod 136 is inserted between the piston actuator 124 and the upper surface of the generator coil 128 until intentional activation of the grenade. Prior to intentional activation of the munition the functioning of the piston actuator 124 is restricted by the rod 136 which blocks the transfer of energy between the piston actuator 124 and the generator core 126 thereby providing the physical out of line safety feature.

In an embodiment, the generator core 126 is a cylindrical shaped custom printed magnetic slug having one or more associated magnetic poles. The cylindrical slug may be formed from a Neodymium-Iron Boron (NdFeB) material and have an approximate length and diameter of 0.375" and 0.25", respectively. The generator coil 128 is a coil formed of a wire having a relatively low impedance. In an embodiment, the coil is Magnet Wire, AWG 20, and formed into a cylindrical coil having a length of 0.375" and an inside diameter such that the generator core 126 can pass through the entire length of the coil.

A bore 132 is aligned concentrically with the generator core 126 and extends orthogonally from the bottom of the generator core 126. The bore 132 has a cross-section which accommodates the generator core 126 cross section thereby allowing the generator core 126 to pass through the center of the bore 132. The generator coil 128 is concentric with the cylindrical bore 132 with the interior volume of the bore 132 serving as the core of the generator coil 128. A return spring 134 is disposed at the bottom the bore 132. Prior to detonation of the grenade, the generator core 126 is restrained from moving within the bore 132 by one or more shear pins.

An electronic time delay circuit 108 is contained within the fuze housing 102 and in electric communication with the inductance generator assembly 106 and the laser igniter assembly 104.

A lever arm 140 of the striker assembly 110 is rotatably attached to the fuze housing 102 by a striker hinge pin 142 adjacent to the electronic time delay circuit 108. An electric safety member 144 extends from the striker assembly lever arm 140 and is contiguous with the electronic time delay circuit 108. The electric safety member 144 is inserted into the electronic time delay circuit 108 and opens a circuit in the electronic time delay circuit 108 thereby disconnecting the inductance generator assembly 106 from the laser igniter assembly 104.

In the embodiment shown in FIG. 2, the out-of-line safety mechanism 112 comprises a rod 136 inserted between the generator core 126 and the piston actuator 124 thereby restricting the function of the piston actuator 124. The rod 136 is held under spring tension by the lever arm 140 of the striker assembly 110.

Figure 3:
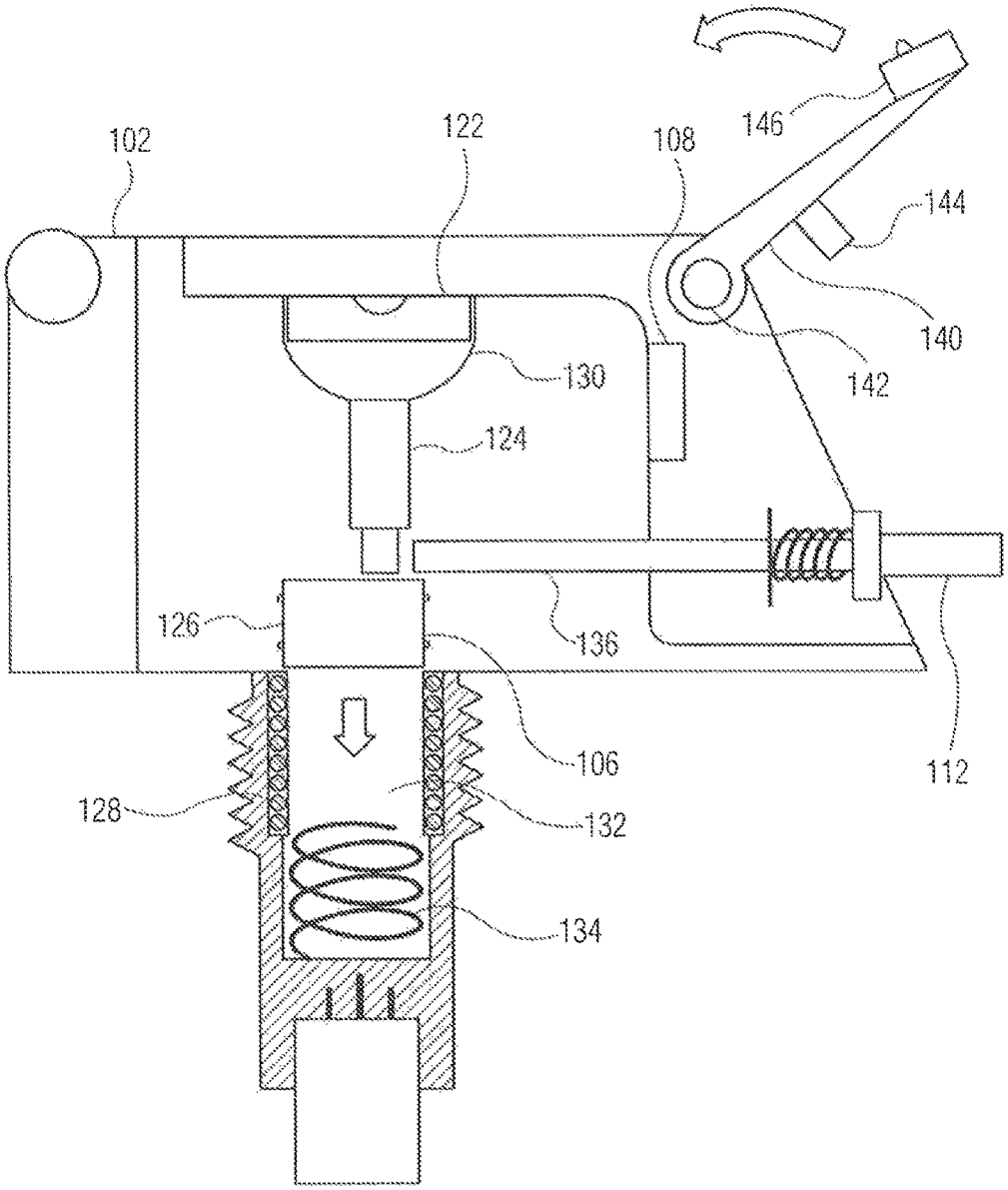
FIG. 3 is a cross-sectional view of the fuze after being activated, in accordance with one illustrative embodiment.

FIG. 3 is a cross-sectional view of the fuze after being activated, in accordance with one illustrative embodiment. When the grenade is in an inactive state, the lever arm 140 is held within the fuze housing 102 under tension by the grenade lever 16 or spoon. To initiate the grenade, a user removes the safety pin 14 which allows the grenade lever 16 to rotate about its hinge. Once the grenade lever 16 is released, the lever arm 140 of the striker assembly 110 also rotates about its hinge 142 thereby causing the striker 146 at the distal end of the lever arm 140 to strike the primer charge 122 with enough force to detonate the primer charge 122.

Simultaneously, the out-of-line safety mechanism 112 and electric safety are disengaged. FIG. 2 shows the physical out-of-line safety mechanism 112 in an engaged state. As described above, a rod 136 is inserted between the generator core 126 and the piston actuator 124 thereby preventing the piston actuator 124 from imparting a force on the generator core 126. The rod 136 is held under tension of a spring by the lever arm 140 of the striker assembly 110 which in turn is held in place by the lever of the grenade.

FIG. 3 shows the physical out-of-line safety 112 mechanism in a disengaged state. The rotation of the lever arm 140 releases the tension on the rod 136 inserted between the generator core 126 and the piston actuator 124 thereby disengaging the physical out-of-line safety. Accordingly, the barrier preventing the piston actuator 124 from communicating with the generator core 126 is removed.

Figure 4:
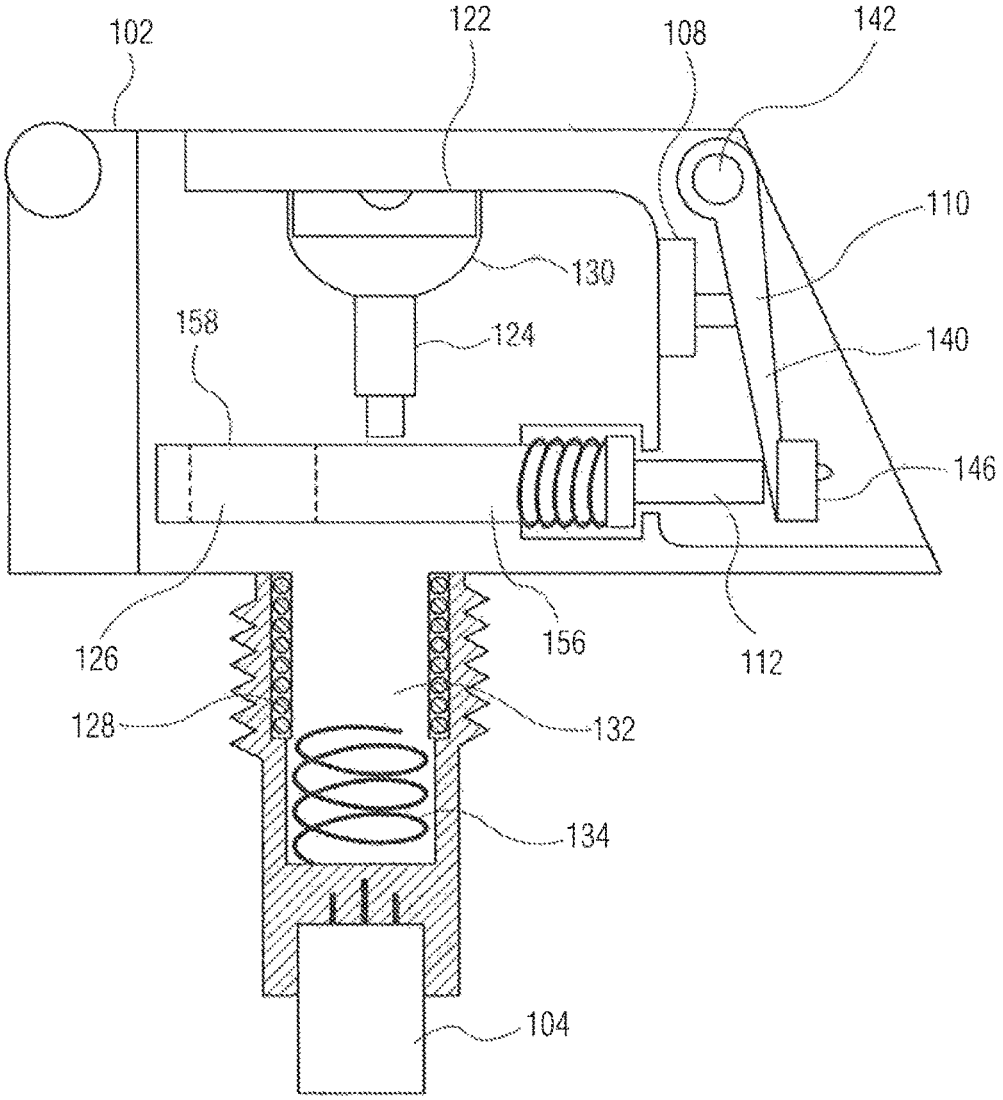
FIG. 4 shows a physical out-of-line-safety mechanism in an engaged state, in accordance with one illustrative embodiment.
Figure 5:
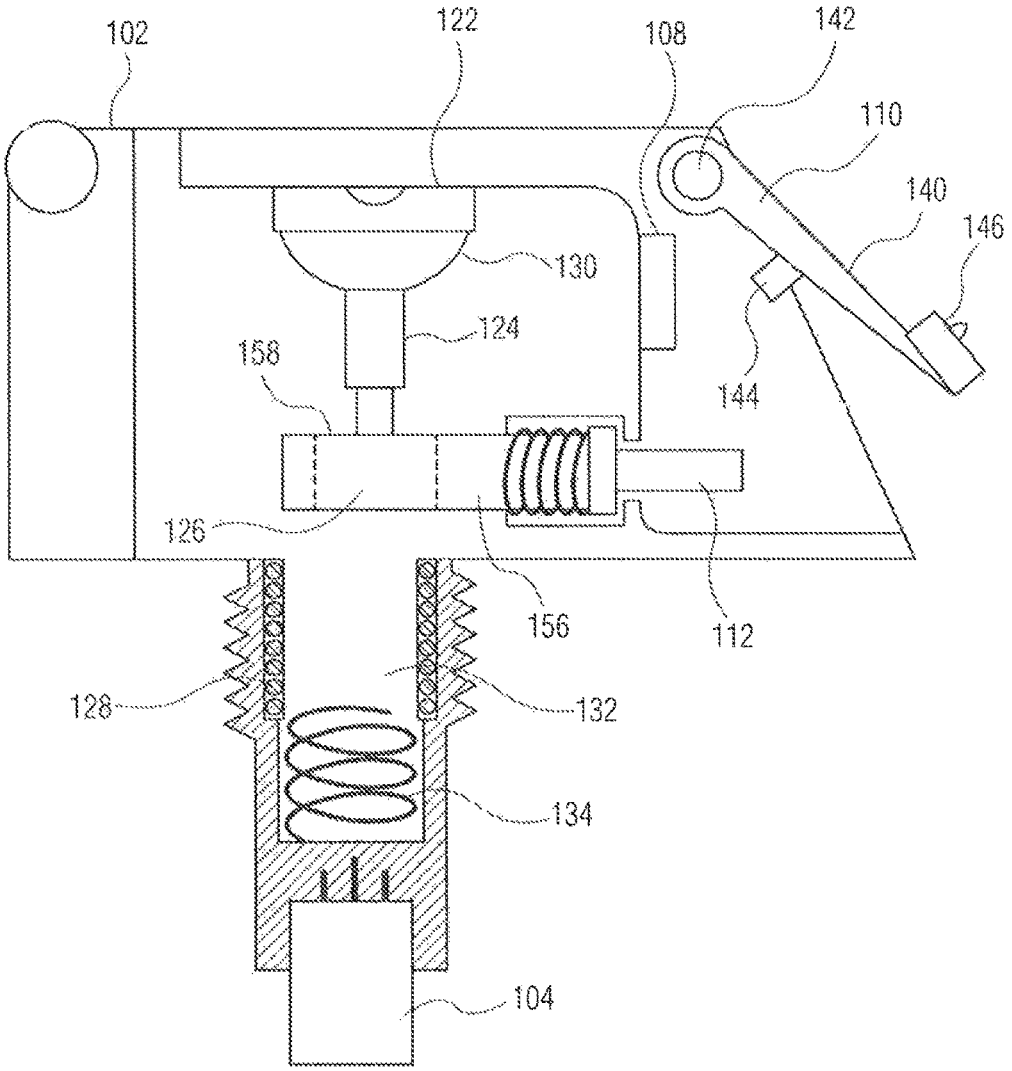
FIG. 5 shows a physical out-of-line safety mechanism in a disengaged state, in accordance with one illustrative embodiment.

FIG. 4 shows a physical out-of-line-safety mechanism in an engaged state, in accordance with one illustrative embodiment. FIG. 5 shows a physical out-of-line safety mechanism in a disengaged state, in accordance with one illustrative embodiment. In an alternate embodiment, the generator core 126 is held out-of-line to prevent inadvertent detonation of the grenade. In this embodiment, a slider 156 is positioned between the piston actuator 124 and the generator coil 128 of the inductance generator assembly 106. The slider 156 comprises an opening 158 extending through the slider 156 for containing the generator core 126. In an engaged state, the slider 156 is restrained by the lever arm 140 of the striker assembly 110 such that the generator core 126 is extended beyond the piston actuator 124. The slider 156 is held by the lever arm 140 under tension by a spring. The rotation of the lever arm 140 releases the tension on the slider 156 thereby causing the slider 156 to retract. In the retracted position, the generator core 126 is aligned with the piston actuator 124 allowing the piston actuator 124 to impart a force on the generator core 126.

Figure 6:
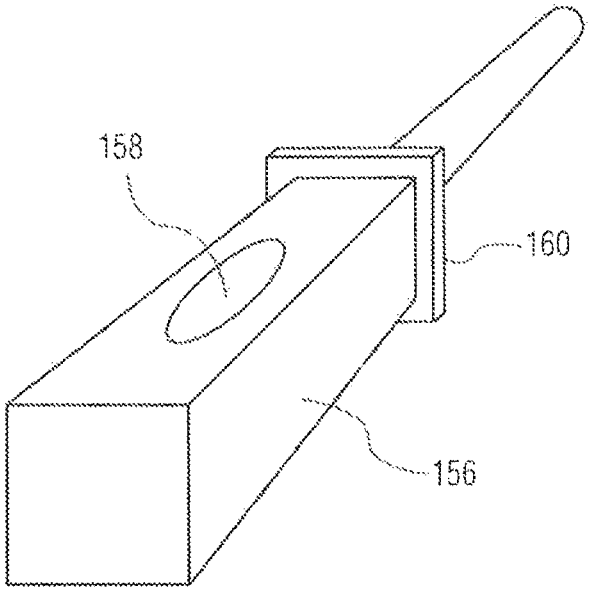
FIG. 6 shows a slide of the physical out-of-line safety mechanism of FIGS. 5 and 6, in accordance with one illustrative embodiment.

FIG. 6 shows a slider of the physical out-of-line safety mechanism of FIGS. 4 and 5, in accordance with one illustrative embodiment. The slider 156 comprises an opening 158 defined by the slider 156 and extending from a top surface to a bottom surface. The opening 158 is sized and dimensioned to receive the generator core 126. A stopper 160 prevents the slider 156 from extending further into the fuze 10 and provides a surface for communicating with the spring. A rod member 162 extending from the stopper interfaces with the lever arm 140 of the striker assembly 110.

Figure 7:
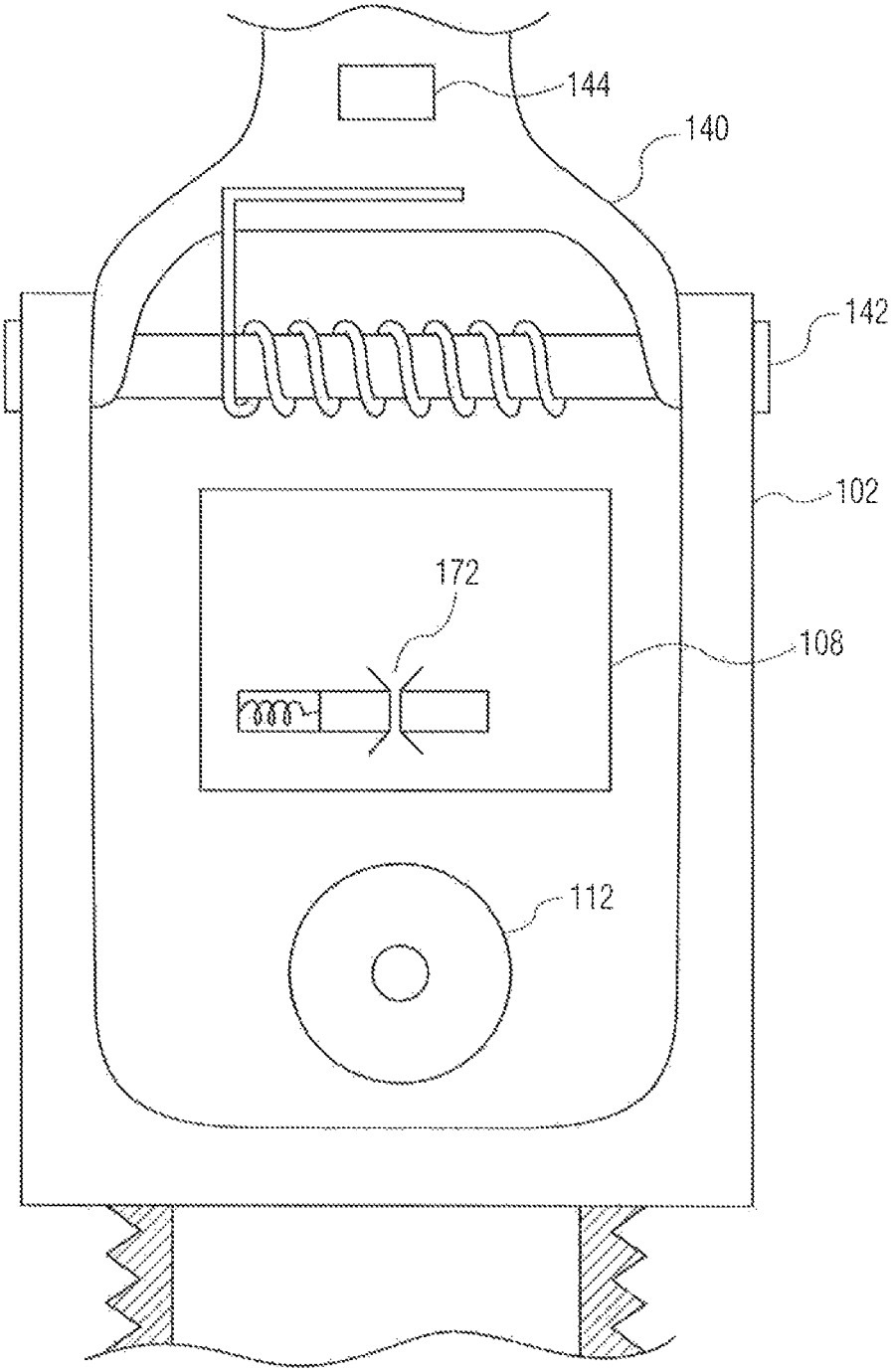
FIG. 7 is a side view of the fuze showing an electric safety mechanism in a disengaged state, in accordance with one illustrative embodiment.

FIG. 7 is a side view of the fuze showing an electric safety mechanism in a disengaged state, in accordance with one illustrative embodiment. Similarly, the rotation of the lever arm 140 causes the electric safety member 144 to be removed from the electronic time delay circuit 108 thereby closing a switch 172 between the inductance generator assembly 106 and the laser igniter assembly 104. The striker assembly 110 comprises a non-conductive electric safety member 144 extending from the lever arm 140. In an engaged state, the electric safety member 144 is inserted into a switch 172 in the electronic time delay circuit 108 thereby opening the switch 172 and preventing electric current to pass through. The electric safety member 144 is held in place under spring tension by the lever arm 140. Upon rotation of the lever arm 140 after activation of the grenade, the electric safety member 144 is removed from the electronic time delay circuit switch 172 thereby disengaging the electric safety. The delay circuit switch 172 is closed allowing electric current to pass from the inductance generator assembly 106 to the laser igniter assembly 104.

Upon detonation of the primer charge 122, the explosive energy of the primer charge 122 is contained within the blast chamber 130 of the inductance generator assembly 106. The explosive energy is transferred to the generator core 126 via the piston actuator 124. For example, the input end of the piston actuator 124 is exposed to the expanding gases contained in the blast chamber 130 which are translated into linear motion. The piston actuator 124 then transfers its momentum to the generator core 126 through a rapid and significant force on the generator core 126.

The force on the generator core 126 severs the shear pin stabilizers holding the generator core 126 in place and causes the generator core 126 to travel with high velocity through the bore 132. The motion of the generator core 126 relative to the generator coil 128 induces rapid magnetic flux in the generator coil 128 thereby producing a voltage. The return spring positioned at the bottom of the bore 132 provides a reactive force on the generator core 126 thereby causing the generator core 126 to travel back through the bore 132 in the opposite direction further inducing magnetic flux in the generator coil 128. As the resulting induced voltage is opposite in polarity, subsequent electronic components, such as a Zener diode are employed to condition the voltage.

The electronic time delay circuit 108 is in electric communication with the inductance generator assembly 106 and the laser igniter assembly 104 with leads extending from the electronic time delay circuit 108 to each. The electronic time delay circuit 108 receives the output of the inductance generator assembly 106 and after a predetermined time supplies a voltage to the laser igniter assembly 104. The delay time of the electronic time delay circuit 108 is designed to meet the needs of the grenade. The output generated by the inductance is accumulated in a capacitor employed by the electronic time delay circuit 108. The electronic time delay circuit 108 incorporates safe and arm features such that, though energized, the fuze 10 is not armed until just prior to the desired detonation time.

Upon passage of the predetermined delay time, the stored energy in the capacitor is supplied to the laser igniter assembly 104 to power an LED laser igniter. The LED laser igniter either directly or through an energetic chain, detonates a primary energetic to produce the intended effect of the grenade. In an embodiment of the invention, the laser diode detonates a nanoenergetic metastable intermolecular composite (MIC) material encapsulated within a detonator case.

Figure 8:
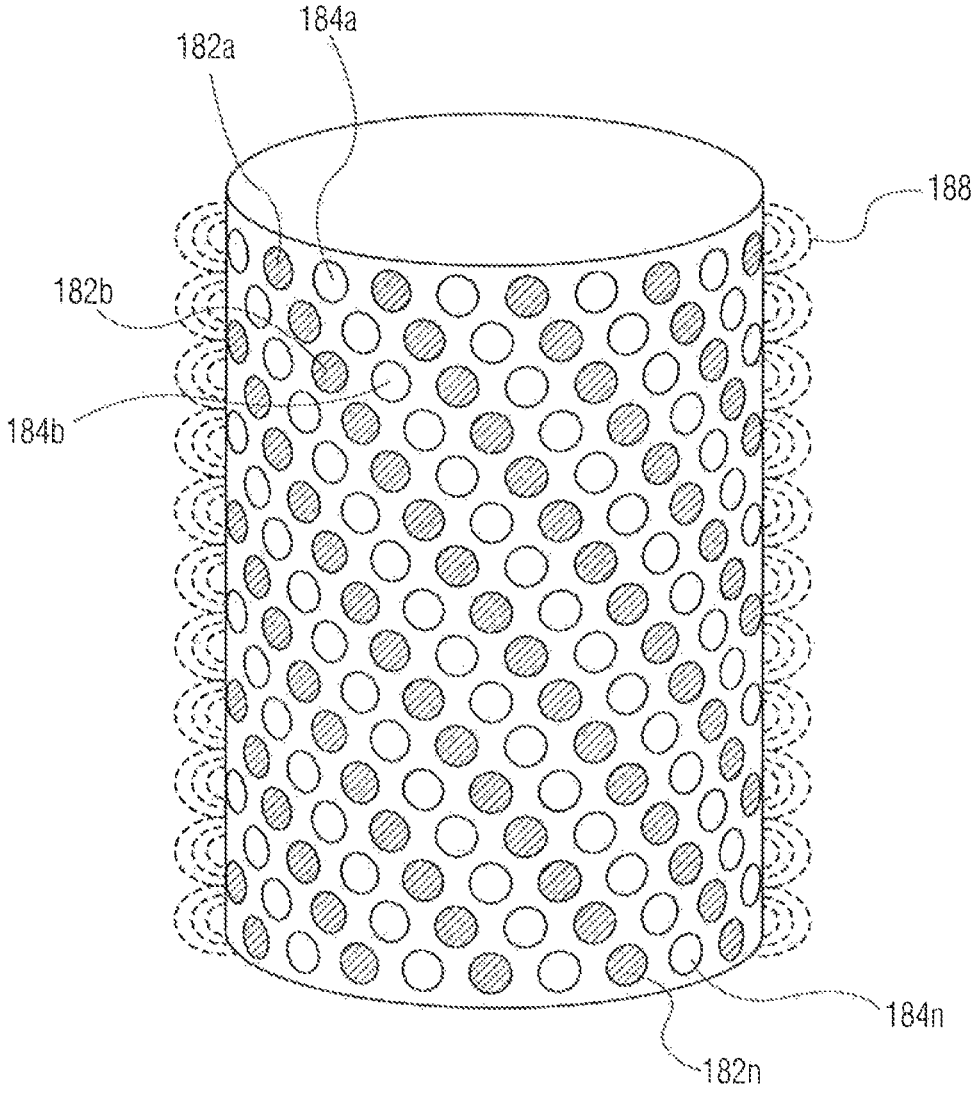
FIG. 8 is a perspective view of a generator core of a blast initiated inductance generator assembly, in accordance with one illustrative embodiment.

FIG. 8 is a perspective view of a generator core 126 of a blast initiated inductance generator assembly 106, in accordance with one illustrative embodiment. The output of the inductance generator assembly 106 is determined by the internal impedance of the generator coil 128 wire, the number of turns in the coil, the magnetic field strength of the generator core 126 and the velocity at which the magnetic flux occurs. To increase the magnetic flux induced in the coil, in an embodiment, the generator core 126 comprises multiple magnetic poles arranged, such as by printing, on the surfaces of the core.

The advantage of using printed poles on the surface of the magnetic core material is that it is possible to finely control the magnetic fields created such that the efficiency of the magnetic flux is greatly increased. In traditional inductance generators, much of the magnetic flux efficiency is lost due to leakage in the magnetic circuit. Placing poles next to each other on the surface of the magnetic material decreases the circuit distance and allows for the circuit to completely saturate the coil. Furthermore, multiple circuits can be created exposing the coil to multiple pulses during a single transition of the core through the coil.

The generator core 126 shown in FIG. 10 is a cylindrical shaped custom printed magnetic slug. The cylindrical magnetic slug may be formed from a Neodymium-Iron Boron (NdFeB) material and have an approximate length and diameter of 0.375" and 0.25", respectively. A plurality of magnetic poles 182*a-n*, 184 *a-n* are arranged alternating in polarity on the outer circumferential surface of the generator core 126 in both the longitudinal and circumferential direction thereby creating a grid pattern of positive magnetic poles 182*a-n* and negative magnetic poles 184 *a-n*. For example, the magnetic poles 182 *a-n*, 184 *a-n* may be encoded on the surface of the generator core 126 using a polymagnet printer. The number, dimensions and orientation of the magnetic poles may be tailored to the desired output of the inductance generator assembly 106. In the embodiment shown, the positive poles 182 *a-n* are represented as shaded and the negative magnetic poles 184 *a-n* are represented as unshaded. The magnetic flux lines 188 between adjacent poles are represented by dotted lines.

Figure 9:
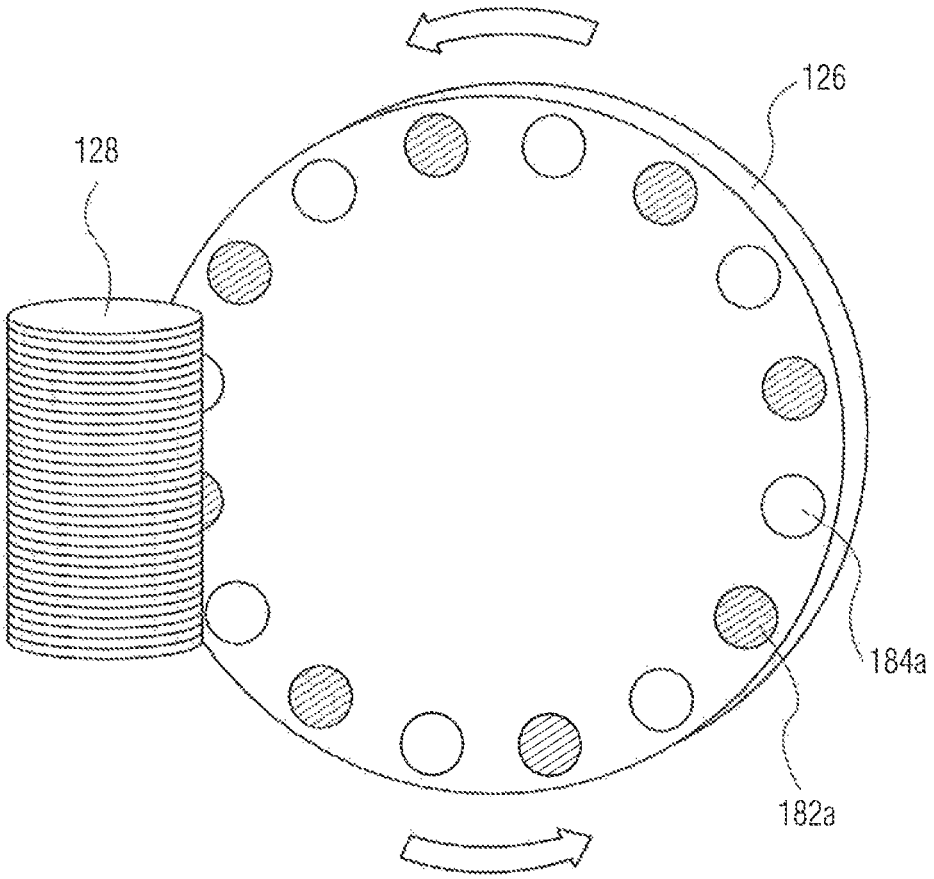
FIG. 9 is a perspective view of a generator core and generator coil of a blast initiated inductance generator assembly, in accordance with one illustrative embodiment.

FIG. 9 is a perspective view of a generator core 126 and generator coil 128 of a blast initiated inductance generator assembly 106, in accordance with one illustrative embodiment. The generator core 126 is not limited to travelling laterally in relation to the generator coil 128. In other embodiments, the generator core 126 and generator coil 128 may be sized and arranged such that the generator core 126 generates magnetic flux by rotating with respect to the generator coil 128. For example, the energetically operated mechanism may impart rotational motion to the generator core 126. As in the previous embodiment, the generator core 126 may include a plurality of magnetic poles arranged on its surfaces to increase the efficiency of magnetic flux generated by the rotational motion.

While the invention has been described with reference to certain embodiments, numerous changes, alterations and modifications to the described embodiments are possible without departing from the spirit and scope of the invention as defined in the appended claims, and equivalents thereof.

What is claimed is:

1. A fuze for a munition comprising:

a laser igniter;

an inductance generator assembly further comprising a generator core, a generator coil, a primer charge and a piston actuator disposed between the primer charge and the generator core such that a detonation of the primer charge provides a force on the piston actuator which the piston actuator transfers to the generator core to propel the generator core into the generator coil to produce electric power for the laser igniter; and a striker assembly which detonates the primer charge of the inductance generator assembly.

2. The fuze of claim 1 wherein the generator core is propelled linearly through a center of the inductor coil as a result of the detonation of the primer charge.

3. The fuze of claim 2 wherein the magnetic core is cylindrically shaped with a plurality of magnetic poles disposed on a circumferential surface of the magnetic core.

4. The fuze of claim 3 wherein the plurality of magnetic poles are arranged sequentially with alternating polarity in both a circumferential direction and an axial direction along a circumferential surface.

5. The fuze of claim 2 wherein the generator core is a rotary disc having a plurality of magnetic poles disposed on a top surface of the rotary disc and wherein the rotary disc is positioned in relation to the generator coil such that rotary motion of the disc induces a magnetic flux in the inductor coil.

6. The fuze of claim 2 wherein the inductance generator assembly further comprises a spring mechanism disposed below the generator coil, the spring mechanism providing an opposing force to the generator core to propel the generator core through the generator coil in an opposing direction.

7. The fuze of claim 1 wherein the striker assembly further comprises an out of line safety mechanism which when in an engaged position holds a component of the inductance generator assembly out of line.

8. The fuze of claim 1 further comprising a delay circuit electrically connected between the inductance generator assembly and the laser igniter wherein the delay circuit receives electric energy produced by the inductance generator assembly and after a predetermined amount of time supplies the electric energy to the laser igniter.

9. The fuze of claim 8 wherein the striker assembly further comprises an electric safety mechanism which when in an engaged position, opens a switch in the delay circuit such that the circuit between the inductance generator assembly and the laser igniter is open.

10. A fuze for a hand grenade comprising:

an inductance generator assembly further comprising a primer charge disposed in a blast chamber, a piston actuator having an input end exposed to an interior of the blast chamber, a bore defined by the inductance generator assembly and extending axially from the piston actuator, a generator core disposed in the bore and aligned with an output end of the piston actuator, and a generator coil concentric with a portion of the bore, wherein the piston actuator transfers energy from a detonation of said primer charge to propel the generator core through the generator coil to produce electric energy;

a laser igniter assembly receiving electric energy;

a delay circuit in electric communication with the inductor generator assembly and the laser igniter assembly and which receives the generated electric energy from the inductance generator assembly and after a predetermined time supplies the electric energy to the laser igniter assembly; and a striker assembly for detonating the primer charge of the inductance generator assembly and further comprising a lever arm wherein when in an engaged position, the lever arm restrains a pin which holds the generator core out of line and opens a circuit between the blast initiated inductance generator assembly and the laser igniter assembly and when in a disengaged state rotates around a hinge to strike the primer charge while allowing the generator core to move in line and completing the circuit between the blast initiated inductance generator assembly and the laser igniter assembly.

11. The fuze of claim 10 wherein the generator core is cylindrically shaped with a plurality of magnetic poles disposed on a circumferential surface of the generator core.

12. The fuze of claim 11 wherein the plurality of magnetic poles are arranged sequentially with alternating polarity in both a circumferential direction and an axial direction along the circumferential surface of the generator core.

13. The fuze of claim 10 wherein the inductance generator assembly further comprises a spring mechanism disposed below the generator coil and providing an opposing force to the generator core to propel the generator core through the generator coil in an opposing direction.

* * * * *